US008905705B2

(12) United States Patent
Bain

(10) Patent No.: US 8,905,705 B2
(45) Date of Patent: Dec. 9, 2014

(54) OMNI-DIRECTIONAL FAN DEVICE

(76) Inventor: Norial P. Bain, Washington, DC (US)

( * ) Notice: Subject to any disclaimer, the term of this patent is extended or adjusted under 35 U.S.C. 154(b) by 677 days.

(21) Appl. No.: 12/815,449

(22) Filed: Jun. 15, 2010

(65) Prior Publication Data

US 2010/0316501 A1 Dec. 16, 2010

Related U.S. Application Data

(60) Provisional application No. 61/187,010, filed on Jun. 15, 2009.

(51) Int. Cl.
*F01D 17/00* (2006.01)
*F01D 19/00* (2006.01)
*F04D 25/10* (2006.01)

(52) U.S. Cl.
CPC ..... *F04D 25/105* (2013.01)
USPC ..... 415/17; 415/48; 415/118; 415/126; 416/37; 416/141; 416/148

(58) Field of Classification Search
USPC ..... 415/14–17, 26, 30, 32, 47, 48, 118, 415/126, 127; 416/35–37, 39, 40, 44, 47, 416/49, 59, 61, 69, 70 R, 72, 70 A, 141, 148
See application file for complete search history.

(56) References Cited

U.S. PATENT DOCUMENTS

| | | | | |
|---|---|---|---|---|
| 4,152,934 | A * | 5/1979 | Weller et al. | 73/170.11 |
| 5,189,412 | A * | 2/1993 | Mehta et al. | 340/12.24 |
| 5,449,275 | A * | 9/1995 | Gluszek et al. | 417/14 |
| 6,050,790 | A * | 4/2000 | Chen | 417/436 |
| 6,283,709 | B1 * | 9/2001 | Hill et al. | 416/110 |
| 6,705,599 | B2 * | 3/2004 | Terrell et al. | 261/30 |
| 2005/0084384 | A1 * | 4/2005 | Delano et al. | 417/42 |
| 2008/0069694 | A1 * | 3/2008 | Hernandez et al. | 416/63 |
| 2011/0192042 | A1 * | 8/2011 | McMurtry et al. | 33/503 |

* cited by examiner

*Primary Examiner* — Edward Look
*Assistant Examiner* — Christopher J Hargitt
(74) *Attorney, Agent, or Firm* — Andrew Rush; PCT Law Group, PLLC

(57) ABSTRACT

An omni-directional air flow device, for example, a fan or a vent associated with a fan, comprises a swivel control point providing almost a spherical range of motion of the air flow device so that air may flow in any direction. The omni-directional air flow device may comprise a user input device for receiving a program for controlling movement of the air flow device through a pre-determined path within the spherical range of motion and for controlling air flow velocity as the air flow device follows the pre-determined path. Moreover, the device may further comprise a controller and memory for storing data representing the pre-determined path and varying air flow velocities along the path. When provided with temperature and humidity sensors coupled to the processor, the processor may calculate a comfort index and adjust the pre-determined path or air flow velocity accordingly. Links between the sensors and the processor, the swivel point and the processor and the user input device and the processor may be wireless.

16 Claims, 4 Drawing Sheets

Fan Device 100

OMNI-DIRECTIONAL FAN DEVICE

This application claims priority to provisional U.S. Patent Application Ser. No. 61/187,010, filed Jun. 15, 2009, the entire disclosure of which is hereby incorporated by reference into the present application.

BACKGROUND OF THE INVENTION

1. Field of the Invention

The present invention generally relates to devices designed to accelerate volumes of air from one location to another, with the purpose of imparting a cooling effect and, more particularly, to an omni-directional air flow device that is user programmable and is adaptive to the environment. Examples of air flow devices include fans, air-conditioners, heating units and directional air flow vents associated therewith.

2. Background

People have used fans to keep cool for a long time. Initially, before the advent of electric and other motors, fans were either self-operated or operated by other people, such as servants. When electric motors became practical, fans powered by these motors came to be available. Such electric fans require access to an electric power source and a means to convert the electric energy into the mechanical energy needed to spin the fan's rotors.

An early problem with electric fans was how to adjust the airflow. The earliest electric fans provided airflows at a single speed and in a single direction. In order to alter the direction of the airflow, it was necessary to physically re-orient the fan. If a beneficiary of the electric fan happened to be sitting down and located remotely from the fan, he or she would have to exert some effort to get up, travel to the fan, and physically alter the direction of the fan and therefore the direction of the airflow. Importantly, the optimal direction of airflow could only be estimated. Additional fine-tuning of the airflow direction would require possibly multiple trips back and forth to the fan and multiple re-orienting efforts.

Further, a uni-directional fan, as described above, would not optimally re-circulate air in its immediate area. By definition, a uni-directional fan would move air solely from the area immediately behind the fan to an area immediately in front of the fan. Areas to either side, or above and below, would not be subject to most of the beneficial air-circulating aspects of the fan operation.

In an attempt to overcome these problems, the concept of adding automatic direction changing systems was introduced. These systems allow the fan to rotate about its axis such that the fan airflow moves along an arc of a certain fixed width. Typically, the fan is connected to a pole or support structure at its base. A rotating force derived from an electric power source is applied at the base of the fan, and the fan begins to rotate around its base, causing the direction of airflow to move laterally through a horizontal arc. The fan continues to move until the rotating base reaches a pre-established limit, or "stop", on horizontal fan travel through the arc. At this point, the direction of rotation around its base is reversed, and the fan begins to return to its original position. The pre-established limit may be a mechanical or electrical adjustment on or in the fan structure.

In some versions, as the fan approaches its limit of fan travel, the rotational velocity of the fan decreases steadily and becomes zero when the fan is positioned at the stop. When the fan begins to rotate in the opposite direction, rotational velocity is increased until the fan approaches an opposite limit of fan travel whereupon the rotational velocity slows once again. This oscillation-like cycle can continue indefinitely for so long as power is available to the fan motor and the fan is turned "on." Other fans are provided with continuously variable potentiometers and the like so that fan speed control is not, for example, limited to three speeds but may be continuously adjusted throughout the entire speed range of the fan motor.

Known central and window-unit air conditioning and heating systems, including space heaters and the like, may have fans and/or vents which are fixed in position and their fans may have speeds which are variable over time as a desired temperature is reached. However, such systems have no user-programmable air flow direction and, while associated humidifiers may have an associated humidity control, overall comfort control is provided without consideration of the environment and a comfort index calculated from both temperature and humidity among other environmental parameters.

Although the above systems improve upon the basic uni-directional electric fan, they do not completely solve the problems enumerated above. Air volumes located above and below the fan do not receive the circulation benefits to the same extent as air volumes located in front and behind the fan. Although the fan operates in a horizontal arc defined by its limit of travel, these types of fans cannot be adjusted to operate in any other manner. For example, they cannot sweep airflow along a vertically-oriented axis. Nor can these fans mix operational modes between horizontal and vertical arcs. That is, in a manner in which the fan, in rotating through its horizontal arc, also moves through a vertical arc at the same time.

Given the foregoing, what is needed in the art is an omni-directional fan device or associated vent system that can be configured to operate and control air flow in any direction, with any speed and orientation and also automatically adapt to surrounding environment thereby requiring a minimum of adjustment and allowing volumes of air on all sides to be adequately re-circulated.

SUMMARY OF THE INVENTION

The present invention meets the above-identified needs by providing a device that allows a fan or associated vent to rotate and change air flow in any direction, have varying speed and adjust in accordance with user programmed instructions or environmental sensing devices.

In an aspect, an omni-directional air flow device is equipped with a fan or vent head that can rotate/swivel unrestrictedly (360 degrees) about the air flow device's vertical, horizontal, or diagonal axis via the release of a locking mechanism. The motion of the fan or vent head therefore is capable of rotating/swiveling circularly from left-to-right or right-to-left, circularly from top-to-bottom or bottom-to-top, or circularly from back-to-front or front-to-back. The fan or vent may be programmed by a user to change direction of air flow in any desired direction or automatically change direction or rotational velocity in response to temperature and humidity environmental measurements.

An advantage of the present invention is that it allows a fan's head or a vent associated with a fan to be easily adjusted in any direction without the strain of having to reposition the entire fan in order to feel the air flow, for example, by controlling an associated motor at a swivel point. By swivel point is intended a point of attachment to an air flow device such that the air flow device is practically unlimited in its range of motion about the swivel point such that air flow may be directed in a direction chosen within a sphere about the swivel point. A limitation on a plurality of directions of air flow may be a pole upon which the air flow device is mounted and the volume consumed by the air flow device such as a fan having a rotating blade. In some embodiments, two or more swivel points may be provided, for example, for a vent system to adjust tilt and twist of the air flow direction as well as to adjust circular direction.

Another advantage of the present invention is that breakage of a fan's head is significantly reduced because of the corresponding reduction of strain on the base structure of conventional electric fans and the increase in the flexibility of the fan's head in an aspect.

Yet another advantage of the present invention is that it provides a more user-friendly experience through ease of usability, enhanced product control including environmental sensors and user programmable air flow rate and direction control.

Yet another advantage of the present invention is to allow improved compliance with increasingly stricter air quality standards established or recommended for workplace and home environments. Moreover, an embodiment is disclosed which may conserve energy or may shut down upon inference of a safety concern.

In order to accomplish these and other advantages, an omni-directional fan device may comprise a programmable microprocessor controller and memory for storage of environmental data such as temperature and wind velocity, fan motor data such as rotational velocity, fan position data such as latitude and longitude data for representing location parameters for controlling movement at first and, if provided, second (and third) swivel points and user input data such as desired fan or vent directional movement and fan motor speed (i.e. rotational velocity) during fan movement. The omni-directional fan may comprise a remote control device for transmitting user input data by wired or wireless means for remotely programming the fan controller. Moreover, certain data such as environmental temperature and humidity data may be sensed at the fan by on-board sensors or remotely transmitted from remote sensor(s) thereof to the fan controller for periodically updating such data in memory. The temperature and humidity data may be used to calculate a known comfort index value and the comfort index value, in turn, used by the programmed controller to selectively adjust fan speed and direction. Moreover, the controller may control any associated humidifier output according to comfort index. In this manner, the fan or vent system for a fan of an air conditioner or heater or stand-alone fan may adapt its air flow direction and velocity to suit sensed environmental conditions. In some embodiments, the fan or vent system may be used in known air conditioning and heating systems for automatic air flow direction and air velocity control and the processor may react to an shut down the fan upon inferring a safety event.

Further features and advantages of the present invention, as well as the structure and operation of various aspects of the present invention, are described in detail below with reference to the accompanying drawings.

BRIEF DESCRIPTION OF THE DRAWINGS

The features and advantages of the present invention will become more apparent from the detailed description set forth below when taken in conjunction with the drawings in which like reference numbers indicate identical or functionally similar elements. Additionally, the left-most digit of a reference number identifies the drawing in which the reference number first appears.

DETAILED DESCRIPTION

The present invention is directed to an air flow control device that allows a fan to rotate in any direction and so control air flow in a plurality of directions as well as air flow velocity as will be described further with reference to FIGS. 1, 2 and 3.

Figure 1:
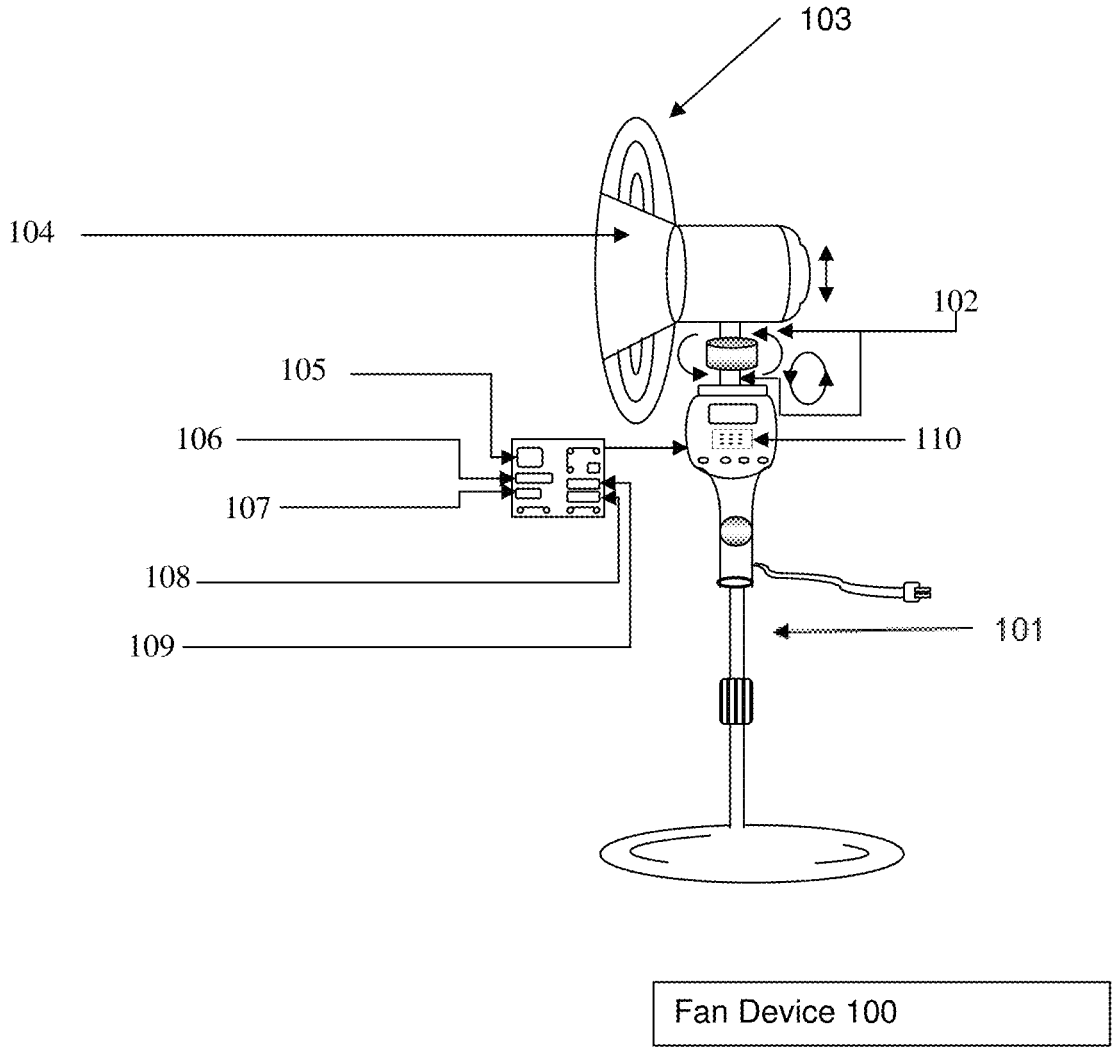
FIG. 1 shows an exemplary aspect of an omni-directional fan device according to an aspect of the present invention.

FIG. 1 presents an exemplary air flow device, for example, a fan device 100 comprising various well-known hardware components and other features in accordance with an aspect of the present invention. This is for convenience only and is not intended to limit the application of the present invention. In fact, after reading the following description, it will be apparent to those skilled in the relevant art(s) how to implement the following invention in alternative aspects.

In an aspect, a fan device 100 includes a floor-mounted omni-directional fan device and is mounted on a floor stand 101. The fan device 100 may be associated with an air conditioner, not shown, or a heating system which may be localized or central (for example, a central air conditioning system or a window unit having a fan and vents). A swivel device 102 is operably attached to floor stand 101 for permitting fan device 100 to change the direction of air flow in any desired direction. The circle depicted in the vicinity of swivel device 102 is intended to represent a full spherical range of motion about the swivel device 102 of an air flow device 103 depicted as a fan. The spherical range of motion may be represented by way of example to latitude and longitude coordinate data of a sphere surrounding the swivel device 102 where other equivalent forms of data for determining a predetermined path of motion of swivel device 102 may be used, and the invention should not be considered to be so limited. The range of motion of air flow device 103 is only limited by the presence of floor stand 101 or other fixing apparatus and the volume of the air flow device 103 itself, as it may touch the floor stand 101 during travel through a pre-determined path.

The swivel device 102 may alternatively be associated with air directional vents, not shown, for an associated fan to likewise change direction of air flow. Such air directional vents comprise tilt and twist elements for changing air flow direction. They may also comprise an air flow damper to provide for changing air flow velocity. In one embodiment, an air flow device may be remotely controlled to provide a predetermined air flow path and changing velocity with latitude and longitude coordinate data. In this aspect, fan 103 or associated vent 104 is able to swivel rotatably around the swivel device 102 and also turn unrestrictedly in a longitudinal direction, transverse to the direction of rotation, in a figure 8 or oval 0 or any desired user programmable motion or pre-determined path and have an associated air flow velocity. Likewise, an associated air flow vent 104 having such a swivel device 102 may permit air flow in virtually any direction.

The motion of fan 103 or an associated vent 104 therefore is capable of rotating/swiveling circularly from left-to-right or right-to-left, circularly from top-to-bottom or bottom-to-top, or circularly from back-to-front or front-to-back. The motion may be in the form of a figure 8, an oval 0 or other desired motion path as programmed by the user according to the flowchart of FIG. 3. Temperature 107, wind speed and humidity sensors 106, may be located proximate to or on board fan 103 or an associated vent 104 for providing current environmental data to a fan, vent controller, not shown in FIG. 1, (but see FIGS. 2 and 3). In an outdoor embodiment, a barometer or other weather sensor may provide useful data to a processor or controller for determining air flow velocity, for example, via rotational velocity of the fan and direction of air flow where the processor or controller more fully described with reference to FIGS. 2 and 3. The pointed arc circle to the right of air flow device 103 is intended to represent a desired, user-programmable air flow direction and path of movement of device 103 which may be automatically modified in response to calculations, for example, of a comfort index. Comfort index may be calculated and defined as follows: an index which gives a numerical value, in the general range of 70-80, reflecting indoor or outdoor atmospheric conditions of temperature and humidity as a measure of comfort (or discomfort) during, for example, a warm season of the year; equal to 15 plus 0.4 times the sum of the dry-bulb and wet-bulb temperatures in degrees Fahrenheit. It is also known in the art as a discomfort index. It is a feature that a controller or processor may selectively utilize a comfort index calculation to change a pre-determined path or air flow device motion and/or air flow velocity.

Figure 2:
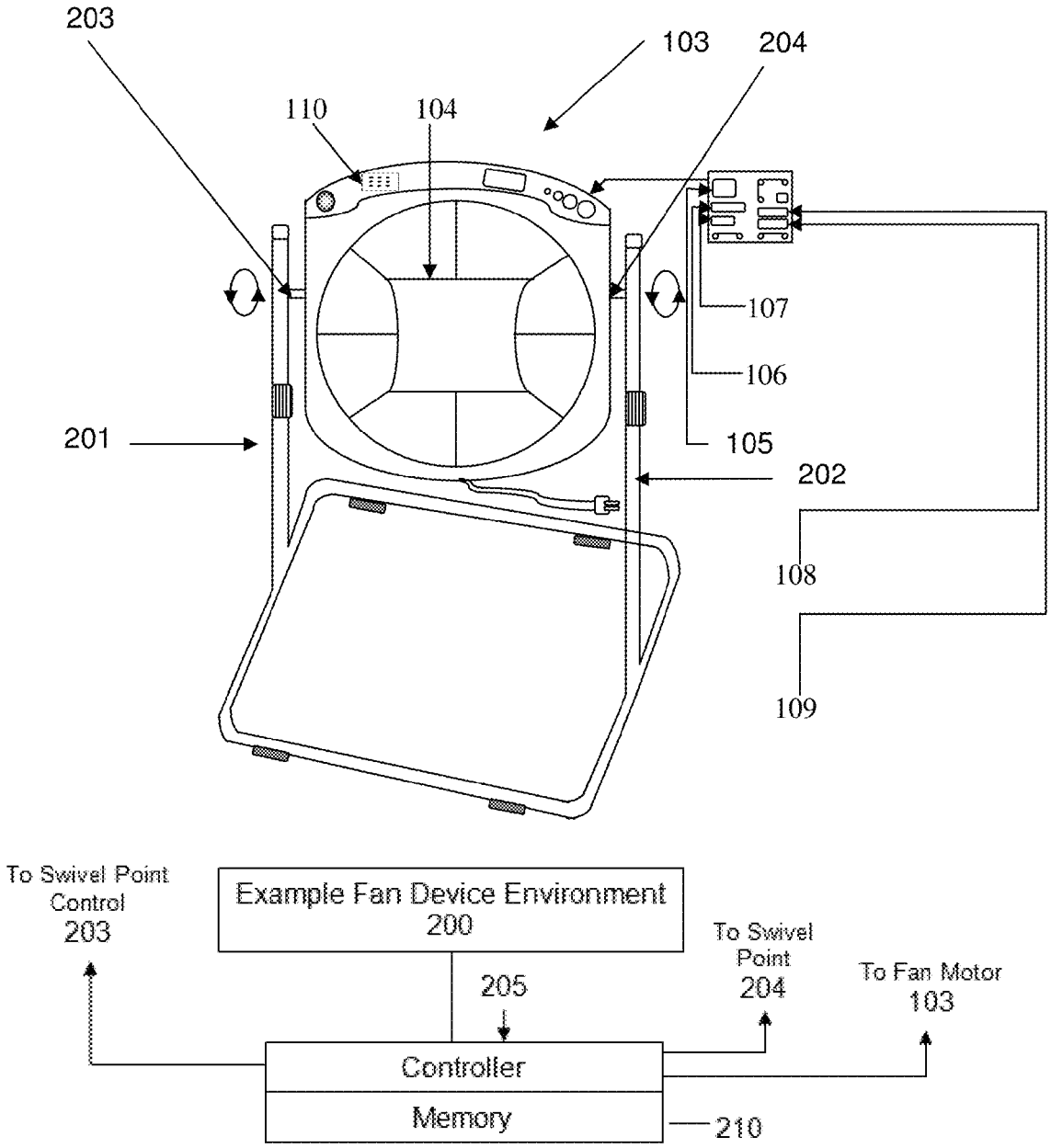
FIG. 2 is an exemplary environment using an omni-directional fan device according to an aspect of the present invention.

In another aspect of the present invention, the omni-directional fan device may be implemented as shown in the example environment 200 of FIG. 2. According to this aspect, fan 103 may be longitudinally fixed and moved from one swivel point 102 as per FIG. 1 or from two swivel points shown, one at left swivel point 203 and one at right swivel point 204. One swivel point may, for example, be responsible for twisting a vent blade and the other responsible for tilting a vent blade; further swivel points may be responsible for providing a circular motion about a swivel point. Fan 103 or an associated vent 104 may, for example, thus rotate unrestrictedly about a longitudinal axis or a latitudinal axis of a sphere and so direct air flow in many directions defined by swivel points 203 and 204 in relation to an air flow device. Fan 103 may be operably attached to left example mounting bracket 201 and right example mounting bracket 202. A path of movement may be programmed by a user of fan 103 via an input device, by inputting coordinate data such as via a remote control, not shown, to controller 205. Controller 205 retains program code in permanent memory for interpreting environmental inputs from environment 200 and also comprises memory for receiving user input generally shown as memory 210.

Swivel devices 102, 203 and 204 have incorporated therewith a mechanism that enables manual, mechanical or electrical adjustment, for example, in the form of a small servomotor or, in another embodiment, a microelectromechanical system or MEMS. The swivel thus may be programmed via processor/controller 205 to follow a pre-determined path of motion and thus, in coordination with movement of other swivel devices, if provided, provide a pre-determined path of motion programmed by a user and, in some embodiments, automatically modified for environmental parameters measured and reported to controller 205. Swivel device 102, 203, 204 may include a support structure in the form of a cylindrical rod, hollow cylindrical rod, sphere or any other suitable support structure configuration. Each such part may be independently controlled and managed. Numerous swivel points at the swivel connection may be implemented to ensure maximum latitudinal and longitudinal articulation. A gas or hydraulic lift, not shown, may be used in an aspect to assist in controlling height adjustment of a fan, other air flow device or associated vent. Moreover, fan or air flow device, for example, rotational velocity may be controlled as well as air flow direction and optimized in accordance with a comfort index calculated by controller 205.

Example fan device environment 100, 200 may be indoors, outdoors or, in other embodiments, may be on board a moving vehicle such as a plane, train refrigeration car or motor vehicle such as a truck or automobile. Other applications for an air flow device may come to mind of one of ordinary skill in the art from an understanding of this detailed description. Typically, an environment 200 may be measured by a thermometer 107 for temperature, an air flow velocity meter 105 for wind velocity (for example, air flow velocity through the fan or vent) and a humidity sensor 106 for humidity. All of these and a barometer in an outdoor environment may signal impending weather or environmental condition data to a controller 205. Controller 205 may store environmental data in memory 210 as well as user input data for air flow direction, a pre-determined path of movement of device 100, 200 and air flow velocity. In response to user input data and collected environmental data, controller 205 may retrieve user data and environmental data, calculate a comfort index and modify a user-selected initial fan or vent 104 motion path and fan velocity. In response, the controller 205 may follow the user input data for direction and fan velocity and/or deviate selectively according to user input as to whether to implement such a feature to adjust for measured comfort index. As indicated in FIG. 2, controller 205 may output commands to swivel point motors or other electronics for controlling at least one swivel point 203, 204 for an associated fan 100, 200 or associated vent 104 and associated fan air flow velocity or rotational speed for fan motor 103. The depicted arrows leaving controller 205 may represent wired or wireless links between the identified elements.

As will be appreciated by those skilled in the relevant art(s) after reading the description herein, in such an aspect, there are many ways an omni-directional fan device and associated vent 104 can be used to achieve the advantages discussed herein. Rather than brackets or supporting structures, aspects may include operable mounting within large industrial or other machines. In another aspect, omni-directional fan device 100 or 200 may be detachably embedded within a roof or other structure in a commercial or residential building. Further, as suggested above, the fan device 100 or 200 or associated vent system having programmable omni-directional air flow may be associated with a central or localized heating or central air conditioning system.

In a further aspect, the omni-directional fan device may be controlled electrically, programmed in advance, remote-controlled through a network or wireless connection, or equipped with suitable sensor devices and pre-programmed instructions for operation when specified pre-determined sensor readings are received by the omni-directional fan device. The programming will be discussed further in connection with the following discussion of flowchart FIG. 3. In an aspect, environmental sensors may be located proximate to or remote to the omni-directional fan device or vent 104 and either wired or wirelessly connected with the omni-directional fan device and controller 205 in particular. In FIG. 2, the line connecting environment 200 and controller 205 may represent a wired or wireless path.

Figure 3:
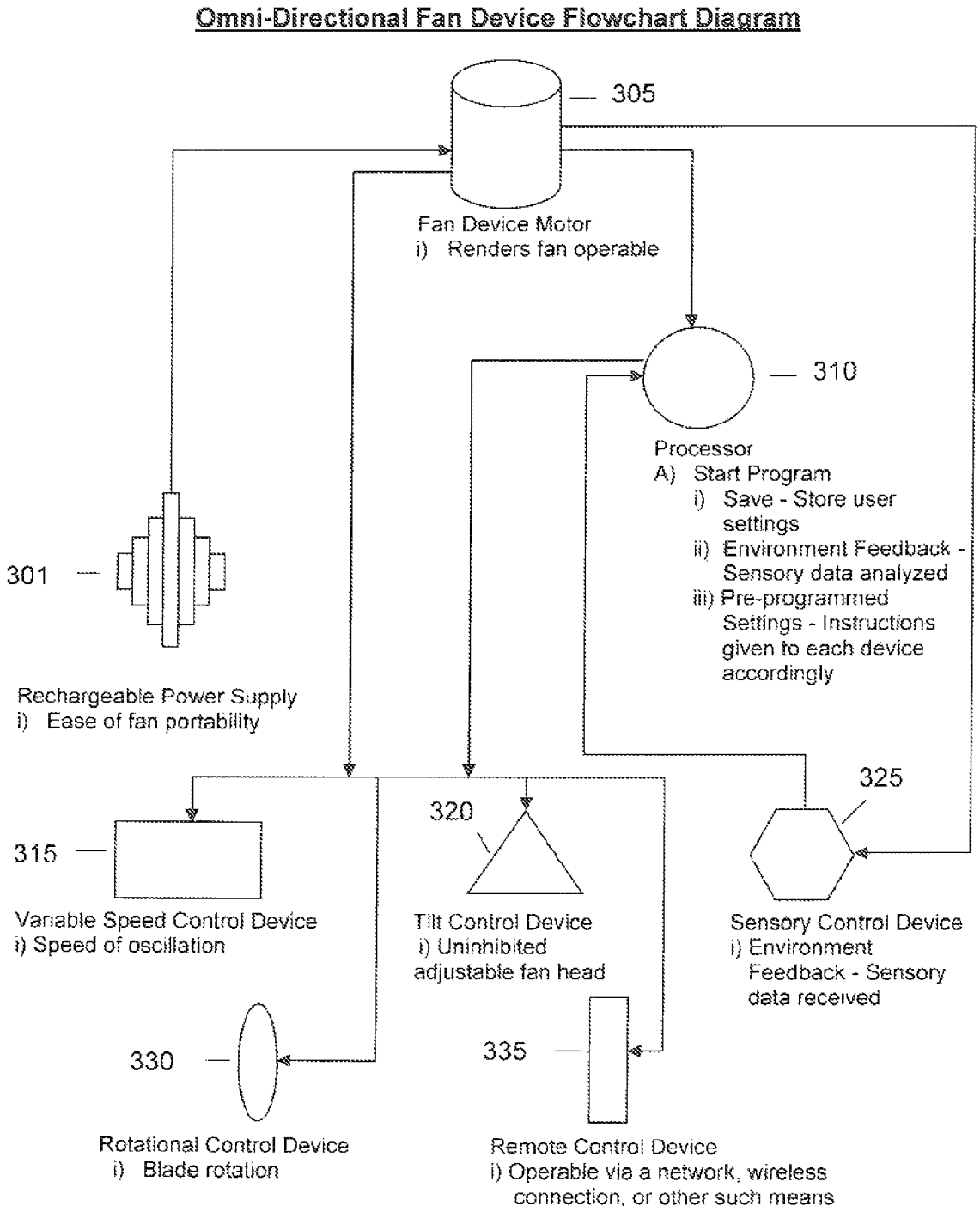
FIG. 3 is an exemplary flowchart for programmable operation of the omni-directional fan device of FIG. 1 or 2.

Referring now to FIG. 3, there is shown a flowchart for operation of air flow device 100, 200 as well as some additional features thereof. In particular, element 301 represents a rechargeable power supply which may involve rechargeable batteries powered and charged via a solar panel or conventional alternating current power or AC power converted to direct current power or combinations thereof. An advantage of using small rechargeable batteries is ease of air flow device 100, 200 portability.

Box 305 represents a fan or air flow device motor or associated vent 104 and, associated therewith may be a simple switch to render the air flow device in an operating state.

Box 310 represents processor/controller 205 and an associated program code described further below.

A first step i) is to save and store user settings. In one embodiment, the user manually moves an air flow device through a desired pre-determined path. Memory 210 retains the manual movement of the air flow device through the pre-determined path. Once the pre-determined path is set in memory 210, the user may actuate the air flow device to follow the path and adjust its speed as the air flow device flows the path. In another embodiment, a joystick 110 of a remote control may be used to control motors to have an air flow device follow a path such that the user desired path may be pre-stored in memory 210 along with a desired air flow velocity setting. As described above, the user input data may be stored in the form of a table of a complete pre-determined path given by latitude and longitude and velocity at the given latitude and longitude.

A second step ii) is to selectively obtain environmental feedback from a plurality of sensors including but not limited to air flow velocity, humidity and temperature. The feature may be selectively actuated by the user. The sensory data is then analyzed to, for example, calculate a comfort index. The calculated comfort index feature, if actuated by the user, may modify the pre-determined air flow device path and velocity set by the user and stored in memory 210. If associated with an air conditioner or heating system having a humidifier, not shown, the humidity may be individually adjusted to improve the comfort index. Hence, there is a series of feedback loops established as seen in FIG. 3 such that air flow direction, velocity and the like may be adjusted continuously bearing in mind the user's initial settings and, electively, environmental parameters sensed by associated sensors.

In one embodiment, a measurement by one of current meter 108 and a power meter 109 used by the fan or vent system can be compared with air flow velocity and conditions inferred that an air flow direction may be limited or blocked. Such an inference may result if the fan is moved, for example, to face a wall and blows back on itself or topples and falls on the floor. A safety consideration is when the fan blade is stopped by an obstacle which may be a human body part. In such instances, the environmental factors can be combined with alternating or direct current or power values, (measurement devices not shown connecting to controller 205) to create an inference of a potential safety or other issue that may be resolved by shutting down the fan or changing fan air flow direction, reducing fan velocity when pointing at a wall or take other action. In one embodiment, an air filter may be dirty and the air flow so impeded by the dirty air flow that the event of a dirty air filter needing cleaning or replacement may be reported to a user via an output device such as a display of device 335.

A third step iii) is to adjust the pre-programmed settings in accordance with changes input by a user, for example, via remote control device 335 or adjust the settings in accordance with changing environmental factors, for example, a periodically re-calculated comfort index. Each swivel, air flow device, humidifier (if provided) and the like receives instructions from controller 205 in response to user input or changing environmental parameters.

Box 315 represents, for example, a continuously variable or three speed (low, medium and high) control for adjusting the speed of oscillation of a fan or other means for adjusting air flow velocity through fan 100, 200 or an associated 104 vent such as the setting of an air flow damper. Control 315 may be wired or wirelessly connected to controller 310. Similarly, rotational control device 330 may be utilized to control fan blade rotation or vent blade movement. Also, tilt control device 320 is shown connected (by wired or wireless means) to processor 310 to provide uninhibited adjustment of a fan or vent head, for example, in a tilt or vertical direction. A similar device, not shown, may provide uninhibited twist control. Yet another device may be provided for a swivel joint and an associated MEMS to provide uninhibited control through an entire sphere of movement.

Box 325 is intended to represent a sensory control device which may be an air flow velocity meter 105, an amperage or power meter 109, a humidity meter 106, a thermometer, 107 a barometer or other environmental or device monitoring means. Such a device may provide environment and device feedback to controller 205, 310 such that an air flow system may automatically adjust to sensed conditions. Sensory data may be periodically or continuously received and stored/updated in memory 210. Similarly, as environmental or device conditions change, controller 205 may adjust, for example, air flow device movement, air flow velocity, shutting down the system in an emergency and the like.

Box 335 is intended to represent a remote control device but may represent a device fixed to the air flow device 100, 200. In general, the remote control 335 may provide a user input to the controller and, in turn, to associated devices depicted for controlling air flow movement, velocity and, in some embodiments, humidity. The remote control device may be wired or wireless in transmitting user input to processor 310. It may receive output from processor 310, for example, indicating that it has received and is processing received user input data. As discussed before, the user may input commands, for example, via a joystick 110, to cause, for example, a fan 100, 200 or vent 104 to follow a desired path according to an input latitude and longitude of a sphere, for example, or change air flow velocity at a point along the pre-determined path and so cause a certain path and related velocity to be stored in memory 210. In one embodiment, the user programming feature may be implemented in two steps: a first step for storing a predetermined program path and a next step of associating a fan or air flow velocity at each latitude and longitude coordinate. The user may then input a desired comfort index or separately input a desired temperature and humidity value.

A further feature of remote control device 335 is that it may be remotely operable via, for example, a communications network, via wireless means or wired means or other such means. For example, via a display screen, not shown, a user may receive visible feedback from controller, processor 205, 310 of an air flow system and the present comfort index, direction of air flow and velocities of a system of air flow devices. By way of example, remote control device 335 may be in the form of a personal data assistant (PDA), mobile phone, personal computer or infrared or radio frequency remote control device.

Figure 4:
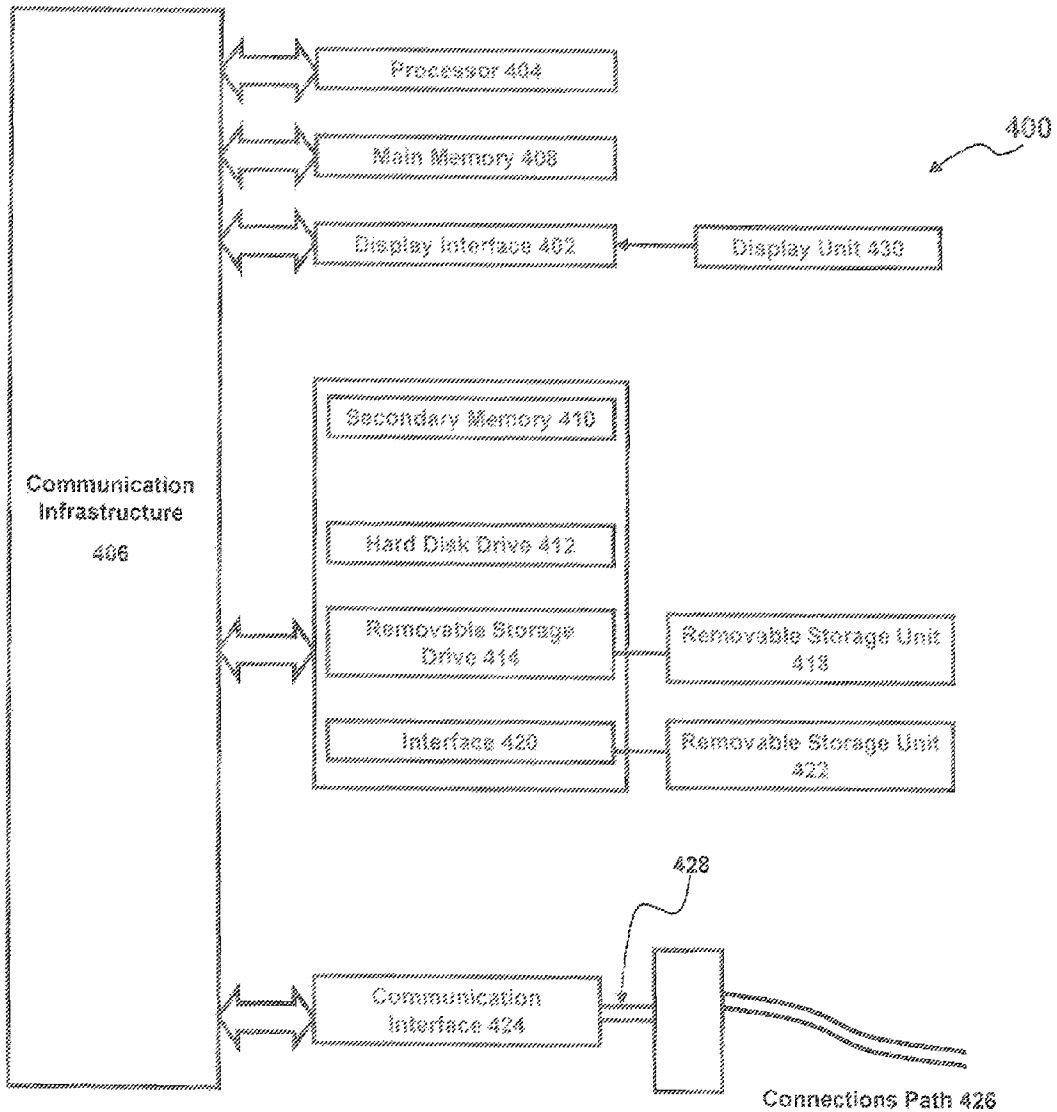
FIG. 4 is a block diagram of an exemplary computer system useful for implementing the present invention.

In fact, in one aspect, the invention is directed toward one or more computer systems capable of carrying out the functionality described herein. An example of a computer system 400 is shown in FIG. 4.

Computer system 400 includes one or more processors, such as processor 404. The processor 404 is connected to a communication infrastructure 406 (e.g., a communications bus, cross-over bar, or network). Various software aspects are described in terms of this exemplary computer system. After reading this description, it will become apparent to a person skilled in the relevant art(s) how to implement the invention using other computer systems and/or architectures.

Computer system 400 can include a display interface 402 that forwards graphics, text, and other data from the communication infrastructure 406 (or from a frame buffer not shown) for display on the display unit 430.

Computer system 400 also includes a main memory 408, preferably random access memory (RAM), and may also include a secondary memory 410. The secondary memory 410 may include, for example, a hard disk drive 412 and/or a removable storage drive 414, representing a floppy disk drive, a magnetic tape drive, an optical disk drive, etc. The removable storage drive 414 reads from and/or writes to a removable storage unit 418 in a well known manner. Removable storage unit 418 represents a floppy disk, magnetic tape, optical disk, ect. which is read by and written to by removable storage drive 414. As will be appreciated, the removable storage unit 418 includes a computer usable storage medium having stored therein computer software and/or data.

In alternative aspects, secondary memory 410 may include other similar devices for allowing computer programs or other instructions to be loaded into computer system 400. Such devices may include, for example, a removable storage unit 422 and an interface 420. Examples of such may include a program cartridge and cartridge interface (such as that found in video game devices), a removable memory chip (such as an erasable programmable read only memory (EPROM), or programmable read only memory (PROM)) and associated socket, and other removable storage units 422 and interfaces 420, which allow software and data to be transferred from the removable storage unit 422 to computer system 400.

Computer system 400 may also include a communications interface 424. Communications interface 424 allows software and data to be transferred between computer system 400 and external devices. Examples of communications interface 424 may include a modem, a network interface (such as an Ethernet card), a communications port, a Personal Computer Memory Card International Association (PCMCIA) slot and card, etc. Software and data transferred via communications interface 424 are in the form of signals 428 which may be electronic, electromagnetic, optical or other signals capable of being received by communications interface 424. These signals 428 are provided to communications interface 424 via a communications path (e.g., channel) 426. This channel 426 carries signals 428 and may be implemented using wire or cable, fiber optics, a telephone line, a cellular link, an radio frequency (RF) link and other communications channels.

In this document, the terms "computer program medium" and "computer usable medium" are used to generally refer to media such as removable storage drive 414, a hard disk installed in hard disk drive 412, and signals 428. These computer program products provide software to computer system 400. The invention is directed to such computer program products.

Computer programs (also referred to as computer control logic) are stored in main memory 408 and/or secondary memory 410. Computer programs may also be received via communications interface 424. Such computer programs, when executed, enable the computer system 400 to perform the features of the present invention, as discussed herein. In particular, the computer programs, when executed, enable the processor 404 to perform the features of the present invention. Accordingly, such computer programs represent controllers of the computer system 400.

In an aspect where the invention is implemented using software, the software may be stored in a computer program product and loaded into computer system 400 using removable storage drive 414, hard drive 412 or communications interface 424. The control logic (software), when executed by the processor 404, causes the processor 404 to perform the functions of the invention as described herein.

In another aspect, the invention is implemented primarily in hardware using, for example, hardware components such as application specific integrated circuits (ASICs). Implementation of the hardware state machine so as to perform the functions described herein will be apparent to persons skilled in the relevant art(s).

In yet another aspect, the invention is implemented using a combination of both hardware and software.

As will also be appreciated by those skilled in the relevant art(s), in an aspect, various configurations are available in response to meeting the needs of commercial and residential heating and cooling. The embodiments described herein may be adapted for vehicular use as well as stationary use.

While various aspects of the present invention have been described above, it should be understood that they have been presented by way of example, and not limitation. It will be apparent to persons skilled in the relevant art(s) that various changes in form and detail can be made therein without departing from the spirit and scope of the present invention. Thus, the present invention should not be limited by any of the above described exemplary aspects.

In addition, it should be understood that the figures in the attachments, which highlight the structure, methodology, functionality and advantages of the present invention, are presented for example purposes only. The present invention is sufficiently flexible and configurable, such that it may be deployed and implemented in ways other than that shown in the accompanying figures.

I claim:

1. An omni-directional air flow system comprising:

a controllable swivel point coupled between a fixed location and an air flow device, the controllable swivel point being controlled to provide a varying direction of air flow in response to user input, the controllable swivel point capable of rotating approximately 360 degrees about a first axis and capable of rotating about a second axis more than 180 degrees;

a user input device for receiving user input for controlling the controllable swivel point and an air flow velocity;

a processor for receiving the user input from the user input device, for storing user input and for controlling the controllable swivel point and air flow velocity of the air flow device; and a memory for storing the user input as received by the processor and program code instructions for controlling the controllable swivel point and air flow velocity, the air flow device being controllable as to the air flow velocity.

2. The omni-directional air flow system of claim 1, further comprising:

an air flow velocity sensor, a temperature sensor and a humidity sensor; the processor for selectively calculating a comfort index and for controlling the controllable swivel point and the air flow velocity in response to data received from the air flow velocity sensor, the temperature sensor and the humidity sensor.

3. The omni-directional air flow system of claim 2, further comprising:

one of a current meter and a power meter, the processor for comparing one of a current value and a power meter value and an air flow velocity and determining an occurrence of an air flow limiting event, the processor, responsive to the determining of the occurrence of an air flow limiting event, for changing operation of the omni-directional air flow system.

4. The omni-directional air flow system of claim 1 wherein the air flow device is a fan, the air flow velocity being controlled by controlling a rotational velocity of the fan.

5. The omni-directional air flow system of claim 2 wherein the air flow velocity sensor, the temperature sensor and the humidity sensor are wirelessly connected to the processor.

6. The omni-directional air flow system of claim 1 wherein the controllable swivel point and the air flow device are wirelessly connected to the processor.

7. The omni-directional air flow system of claim 1 wherein the user input device is a remote control device and the remote control device is wirelessly connected to the processor.

8. The omni-directional air flow system of claim 7 wherein the remote control device comprises a telecommunications device including a display for displaying parameters associated with movement and air flow velocity of the air flow device.

9. The omni-directional air flow system of claim 1 wherein the user input device comprises a joystick for outputting latitude and longitude coordinate data for a pre-determined movement path of the air flow device.

10. The omni-directional air flow system of claim 4 further comprising a rechargeable power supply and the fan is portable.

11. An omni-directional air flow system comprising:

a controllable swivel point coupled between a fixed location and an air flow device, the controllable swivel point being controlled to provide a varying direction of air flow in response to user input, the controllable swivel point capable of rotating approximately 360 degrees about a first axis and capable of rotating about a second axis more than 180 degrees;

a user input device for receiving user input for controlling the controllable swivel point and an air flow velocity;

a processor for receiving the user input from the user input device, for storing user input and for controlling the controllable swivel point and air flow velocity of the air flow device;

a memory for storing the user input as received by the processor and program code instructions for controlling the controllable swivel point and air flow velocity, the air flow device being controllable as to the air flow velocity;

an air flow velocity sensor;

a temperature sensor; and a humidity sensor; the processor for selectively calculating a comfort index and for controlling the controllable swivel point and the air flow velocity in response to data received from the air flow velocity sensor, the temperature sensor and the humidity sensor to adjust one of an air flow velocity and an air flow direction.

12. The omni-directional air flow system of claim 11, further comprising:

one of a current meter and a power meter, the processor for comparing one of a current value and a power value and air flow velocity and determining an occurrence of an air flow limiting event, the processor, responsive to the determining of the occurrence of an air flow limiting event, for changing operation of the omni-directional air flow system.

13. The omni-directional air flow system of claim 12 wherein the air flow device is a fan, the air flow velocity being controlled by controlling a rotational velocity of the fan.

14. The omni-directional air flow system of claim 13 further comprising a rechargeable power supply and the fan is portable.

15. An omni-directional air flow system comprising:

a controllable swivel point coupled between a fixed location and an air flow device, the controllable swivel point being controlled to provide a varying direction of air flow in response to user input, the controllable swivel point capable of rotating 360 degrees about a first vertical axis extending from a swivel point center and capable of independently rotating more than 180 degrees in a vertical plane passing through the swivel point center;

a user input device for receiving user input for controlling the controllable swivel point and an air flow velocity;

an air flow velocity sensor;

a temperature sensor;

a humidity sensor;

a processor for receiving the user input from the user input device, for storing user input, for controlling the controllable swivel point and air flow velocity of the air flow device, for selectively calculating a comfort index and for controlling the controllable swivel point and the air flow velocity in response to data received from the air flow velocity sensor, the temperature sensor and the humidity sensor;

a memory for storing the user input as received by the processor and program code instructions for controlling the controllable swivel point and air flow velocity, the air flow device being controllable as to the air flow velocity; and one of a current meter and a power meter, the processor for comparing one of a current value and a power meter value and the air flow velocity and determining an occurrence of an air flow limiting event, the processor, responsive to the determining of the occurrence of an air flow limiting event, for changing operation including positioning of the omni-directional air flow system.

wherein the air flow velocity sensor, the temperature sensor and the humidity sensor are wirelessly connected to the processor and are positionable as a unit separately from the air flow device;

wherein the user input device comprises a ioystick for outputting latitude and longitude coordinate data for a pre-determined movement path of the air flow device;

wherein the pre-determined movement path of the air flow device is a figure-eight;

wherein the controllable swivel point is a ball joint;

wherein the air flow device comprises a housing that further comprises a motor configured to rotate a plurality of revolving vane elements;

wherein the controllable swivel point is electronically controllable;

wherein the airflow device is solely connected to the controllable swivel point at an airflow device end portion; and wherein air flow may be directed in a direction chosen within a sphere about the controllable swivel point.

16. The omni-directional air flow system of claim 11, wherein the airflow device is solely connected to the controllable swivel point at an airflow device end portion.

* * * * *